US007033441B2

(12) United States Patent
Okimoto et al.

(10) Patent No.: US 7,033,441 B2
(45) Date of Patent: Apr. 25, 2006

(54) APPLICATOR FOR STRINGS

(75) Inventors: Kenji Okimoto, Hiroshima (JP); Keiko Okimoto, Hiroshima (JP)

(73) Assignee: The San-Ai Co., Ltd., Hiroshima (JP)

( * ) Notice: Subject to any disclaimer, the term of this patent is extended or adjusted under 35 U.S.C. 154(b) by 19 days.

(21) Appl. No.: 10/692,752

(22) Filed: Oct. 27, 2003

(65) Prior Publication Data

US 2004/0214976 A1 Oct. 28, 2004

Related U.S. Application Data

(63) Continuation of application No. PCT/JP03/05333, filed on Apr. 25, 2003.

(51) Int. Cl.
*B05C 11/02* (2006.01)

(52) U.S. Cl. ..... 118/264; 118/234; 427/429

(58) Field of Classification Search ..... 118/234, 118/236; 427/429

See application file for complete search history.

(56) References Cited

U.S. PATENT DOCUMENTS

| | | | | |
|---|---|---|---|---|
| 6,358,893 | B1 * | 3/2002 | ZechmanI et al. | 508/215 |
| 6,519,440 | B1 * | 2/2003 | Kimura et al. | 399/325 |
| 2004/0244682 | A1 * | 12/2004 | Boler, Jr. | 118/264 |

FOREIGN PATENT DOCUMENTS

| | | | |
|---|---|---|---|
| DE | 2165512 | * | 7/1973 |
| EP | 775994 | A2 * | 8/1997 |
| JP | 56049170 | A * | 5/1981 |
| JP | 63-51873 | A1 | 3/1988 |
| JP | 2001-123117 | A1 | 5/2001 |
| WO | WO-97/40228 | | 10/1997 |
| WO | WO-2004000547 | A1 * | 12/2003 |

OTHER PUBLICATIONS

"Determiniation of Oxygen in Organosilicon Polymers and Organic Materials by Inert-Gas Fusion with a Platinum-Carbon Converter", Aramata et al. in Analytical Science, Jun. 1998, vol. 14 p. 541.*

* cited by examiner

*Primary Examiner*—Marc S Zimmer
(74) *Attorney, Agent, or Firm*—Rader, Fishman & Grauer PLLC

(57) ABSTRACT

The object of the present invention is to prevent damage on surface of strings and make the strings less twistable to improve elasticity, bounce etc., and further avoiding uncomfortable touch at the moment of hitting a ball.

The applicator for strings of the present invention is polydimethylsiloxane containing scourer and colorant and having viscosity of 100 to 1000 cs, which is retained in a sponge-like retainer.

7 Claims, No Drawings

APPLICATOR FOR STRINGS

CONTINUING DATA

This application is a continuation of PCT/JP03/05333 filed Apr. 25, 2003.

TECHNICAL FIELD

The present invention relates to an applicator for strings

More particularly, the present invention relates to an applicator for strings stretched over a racket used in tennis, badminton etc.

BACKGROUND ART

As used, strings stretched over a racket are damaged on surface by frictions between strings or with balls.

As damaged on surface, longitudinal and transverse strings engage each other at intersections and make notches.

Notched strings are twisted and degraded in elasticity, bounce, etc., while causing more vibrations at the moment of hitting a ball.

Then, technique for improving strings in elasticity, bounce, etc., is desired.

For example, resin coating technique for improving ball control of a racket is known (see International Publication No. WO97/40228).

This technique makes strings adhere to each other so as to fix longitudinal and transverse strings at intersections, with the use of a coating agent of solution which consists of 1 to 50% recent resin or fossil resin in low boiling point organic solvent, to prevent strings from twisting for better ball control.

However, depending on their skills, some users feel uncomfortable when hitting a ball with such a racket that longitudinal and transverse strings are fixed at intersections.

Then, the object of the present invention is providing means for preventing strings from being damaged on surface, making them be hard to twist and improving them in elasticity, bounce, etc., without the uncomfortable touch at the moment of hitting a ball

DISCLOSURE OF THE INVENTION

The present inventor worked hard to solve the above problems and considered that it would be better to make strings be free to move as brand-new condition, rather than to make them adhere to each other.

Then, the present inventor found out that dimethyldichlorosilane polymer (also known as "polydimethylsiloxane" which is the polymerized product of dimethyldichlorosilane) is advantageously used for notched strings and achieved completion of the present invention. Hereinafter, all instances of the term "dimethyldichlorosilane polymer" is interchangeable with the term "polydimethylsiloxane".

To sum up, the problems are solved in the present invention by means as follows.

1) Applicator for strings characterized in that polydimethylsiloxane is retained in a retainer.

2) Applicator for strings according to the above 1 characterized in that polydimethylsiloxane has a viscosity of 40 to 1000 cs.

3) Applicator for strings according to the above 1 characterized in that polydimethylsiloxane has a viscosity of 100 to 1000 cs.

4) Applicator for strings according to any one of the above 1 to 3 characterized in that polydimethylsiloxane contains scourer.

5) Applicator for strings according to any one of the above 1 to 4 characterized in that polydimethylsiloxane contains colorants.

6) Applicator for strings according to any one of the above 1 to 5 characterized in that the retainer has liquid absorbing and retaining properties.

ADVANTAGEOUS EFFECTS OF THE INVENTION

With the use of an applicator of the present invention, strings are coated with polydimethylsiloxane not to disturb the moving of longitudinal and transverse strings at intersections. Then, when a ball touches the strings, intersections of longitudinal and transverse strings move in accordance with contact part with the ball, and strings are deeply dented and greatly deformed locally around the impact, thereby enabling a better ball holding.

As a result, strings become hard to be damaged and twisted, and get better elasticity, bounce, etc., also with less vibration at the moment of hitting a ball.

More specifically, since a ball holding becomes better and deformation of strings is limited to a smaller area, the length of vibrating string becomes shorter, preventing big vibrations, and avoiding uncomfortable touch by hitting a ball, regardless of the user's skills.

In addition, a better ball holding enables better ball control even when user hits the ball at a point outside the sweet area, and hence, reducing missed shots.

Such effects are particularly advantageous for strings damaged as used.

In other words, notched strings (i.e., longitudinal and transverse strings engaging each other at intersections) degraded in elasticity, bounce, etc. can recover the original performance just as brand-new, thanks to application of polydimethylsiloxane by using an applicator for strings according to the present invention.

BEST MODE OF REALIZATION OF THE INVENTION

The present invention will be explained here below, referring to realization examples. However, the technical scope of the present invention is not restricted by the following realization or test examples.

REALIZATION EXAMPLE 1

(Different Viscosities)

Applicators for strings in this realization example contain 9 different types of polydimethylsiloxanes having viscosities of 10, 20, 30, 50, 100, 200, 300, 500 and 1000 cp, which are absorbed in sponge as a retainer.

Sponge used in this realization example has a cylindrical shape about 5 cm in diameter and about 3.5 cm in height. Additionally, the opposite face to the application face, i.e., a fixed face, is fixed to the main body of a container comprised of a lid about 1.2 cm thick and a main body about 1.4 cm deep.

The sponge contains about 0.7 cc of polydimethylsiloxane uniformly by being sprayed from a nozzle in the form of mist.

The sponge is housed when it is not used, as pressed with the main body and the lid put together, into a cylindrical container 1.8 cm thick.

To use it, hold the main body with hand and open the lid. Then, the sponge the fixed face thereof is fixed to the main body uprises to be ready for use.

Next, the steps for applying polydimethylsiloxane on longitudinal and transverse strings stretched over a racket by the use of the above applicator will be explained.

Hold the main body of the above applicator with hand to bring the applying face of the sponge into contact with the strings stretched over the racket, and rub it against them to apply polydimethylsiloxane on the both faces of strings.

Hereat, by rubbing the applying face of the sponge against strings and somewhat dislocating the longitudinal and transverse strings consciously, polydimethylsiloxane is applied also at intersections of the longitudinal and transverse strings.

Finally, polydimethylsiloxane is applied on surfaces of the longitudinal and transverse strings.

Strings, thus coated with polydimethylsiloxane, are deeply dented and greatly deformed locally around the impact, without being disturbed in moving at intersections of the longitudinal and transverse strings.

REALIZATION EXAMPLE 2

(Containing Scourer)

An applicator in this realization example contains about 0.7 cc of mixture of polydimethylsiloxane having a viscosity of 96 to 100 cp and 10% scourer by weight, which is absorbed in sponge as a retainer.

Sponge used in this realization example has a cylindrical shape about 5 cm in diameter and about 3.5 cm in height. Additionally, the opposite face to the application face, i.e., a fixed face, is fixed to the main body of a container comprised of a lid about 1.2 cm thick and a main body about 1.4 cm deep.

The sponge is housed when it is not used, as pressed with the main body and the lid put together, into a cylindrical container 1.8 cm thick.

To use it, hold the main body with hand and open the lid. Then, the sponge the fixed face thereof is fixed to the main body uprises to be ready for use.

Next, the steps for applying polydimethylsiloxane containing scourer on longitudinal and transverse strings stretched over a racket by the use of the above applicator will be explained.

Hold the main body of the above applicator with hand to bring the applying face of the sponge into contact with the strings stretched over the racket, and rub it against them to apply polydimethylsiloxane containing scourer on the both faces of strings.

Hereat, by rubbing the applying face of the sponge against strings and somewhat dislocating the longitudinal and transverse strings consciously, polydimethylsiloxane containing scourer is applied also at intersections of the longitudinal and transverse strings.

The surfaces of strings, chapped as used, are applied polydimethylsiloxane containing scourer, being polished and recovering the smoothness as brand-new thanks to the scourer on the applying face.

Finally, polydimethylsiloxane containing scourer is applied on surfaces of the longitudinal and transverse strings.

Then, longitudinal and transverse strings are coated with polydimethylsiloxane containing scourer, almost recovering the smooth surface when brand-new.

Strings, thus coated with polydimethylsiloxane containing scourer, are deeply dented and greatly deformed locally around the impact, without being disturbed in moving at intersections of the longitudinal and transverse strings.

Otherwise, polydimethylsiloxane containing scourer may be applied on the strings by the use of the above applicator by the following steps.

Polish the string surfaces with an electric polisher before application.

Strings are polished its front face first and then back face with scourer on the polisher's cloth.

Hereat, if string faces are heated by friction with the polisher's cloth, stop polishing and wait until it is cooled down to the room temperature.

Then, start polishing again at the room temperature.

Thus, string surfaces are polished previously by being polished front face and back face about 8 times.

Dimethyidichlorosilane polymer containing scourer is more advantageously applied by the use of the above applicator on longitudinal and transverse strings stretched over a racket which are heated to 40 to 80° C. after polishing.

REALIZATION EXAMPLE 3

(Containing Scourer and Colorant)

An applicator in this realization example contains about 0.7 cc of mixture of polydimethylsiloxane having a viscosity of 96 to 100 cp, 10% scourer by weight, and colorant, which is absorbed in sponge as a retainer as in realization example 2.

Dimethyldichlorosilane polymer with scourer and colorant is applied on strings stretched over a racket by the use of the above applicator according to the same steps as in realization example 2.

Incidentally, conditions of polydimethylsiloxane applied on strings can be checked directly with eyes, since strings are colored with colorant mixed with the polymer, thus enabling assessment of sustainability of the effects.

TEST EXAMPLES 15 rackets with brand-new strings stretched over were used in the same conditions until strings become twisted.

Then, as comparative examples, instead of polydimethylsiloxane, fluorine oil, engine oil, tempura oil or grease, which have viscosity of 100 cp were applied on the strings of the rackets respectively, after absorbed into sponge as in realization example 1.

On the other hand, as inventive example 1, the applicators for strings of realization example 1 were used for application on strings of the rackets, respectively.

Then, as inventive example 2, the applicator for strings of realization example 2 was used for application on strings of rackets.

Then, as inventive example 3, the applicator for strings of realization example 3 was used for application on strings of rackets.

The respective rackets of the comparative examples and inventive examples were checked about deflection with load and tested by hitting balls actually in the same conditions.

The hitting performance was judged by how many times hitting should be repeated until the effect becomes lost (i.e., returning to the condition before application), and marked with X if the effect is lost with about 10 shots, ○ if the effect is kept despite with about 100 hits and ◎ if the effect is kept even with 300 hits or more.

The results were as follows.

About deflection with load, all of the inventive examples 1 to 3 have deflection of 0.6 to 0.7 mm, while none of the comparative examples have deflection.

Then, regarding the hitting performance, in inventive example 1, viscosity of 10 to 30 cp is marked with X, viscosity of 50 cp is marked with ○ and viscosity of 100 to 1000 cp is marked with ◎.

However, as for viscosity of 200 to 1000 cp, it required a wipe after application.

Moreover, inventive examples 2 and 3 were both marked with ◎ about the hitting performance.

Here it is confirmed that, by the use of the applicator for strings containing colorant of inventive example 3, conditions of polydimethylsiloxane containing scourer and colorant applied on strings can be checked directly with eyes, since strings are colored with colorant mixed with the polymer and scourer, thus enabling assessment of sustainability of the effects.

What is claimed is:

1. An applicator comprising a retainer fixed to a body, wherein the retainer retains a polydimethylsiloxane and colorants.

2. The applicator according to claim 1, wherein the retainer has liquid absorbing and retaining properties.

3. The applicator according to claim 1, wherein the polydimethylsiloxane has a viscosity of 40 to 1000 cs.

4. The applicator according to claims 1, wherein the polydimethylsiloxane has a viscosity of 100 to 1000 cs.

5. The applicator according to claim 1, wherein the retainer is a sponge.

6. An applicator comprising a retainer fixed to a body, wherein the retainer retains a polydimethylsiloxane and a scourer, and wherein the scourer is present in an amount of about 10% by weight.

7. An applicator comprising a retainer fixed to a body, wherein the retainer retains a polydimethylsiloxane and a scourer, and wherein the retainer is a sponge.

* * * * *